US006715872B2

(12) United States Patent
Kanome

(10) Patent No.: US 6,715,872 B2
(45) Date of Patent: Apr. 6, 2004

(54) SHEET CONVEYING DEVICE AND IMAGE FORMING APPARATUS INCLUDING THE SAME

(75) Inventor: Osamu Kanome, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/244,518

(22) Filed: Sep. 17, 2002

(65) Prior Publication Data

US 2003/0063174 A1 Apr. 3, 2003

(30) Foreign Application Priority Data

Oct. 2, 2001 (JP) ..... 2001-306152

(51) Int. Cl.[7] ..... B41J 2/01

(52) U.S. Cl. ..... 347/104; 271/193; 400/636

(58) Field of Search ..... 347/104; 271/193; 400/636, 637.3, 639.1, 637.5, 637.6

(56) References Cited

U.S. PATENT DOCUMENTS 6,332,612 B1 * 12/2001 Kanemura ..... 271/275

* cited by examiner

*Primary Examiner*—Charles H. Nolan, Jr.
*Assistant Examiner*—Ly T Tran
(74) *Attorney, Agent, or Firm*—Fitzpatrick, Cella, Harper & Scinto

(57) ABSTRACT

A sheet conveying device includes an endless conveyor belt which has an electrode unit for retaining the sheet by using an electric force and which rotates while retaining the sheet so as to convey the sheet, a first electricity-supplying unit which applies a voltage to the electrode unit while it passes through a predetermined area, a second electricity-supplying unit which is disposed at a predetermined position which is upstream of the predetermined area and downstream of a position where the conveyor belt receives the sheet along a sheet-conveying path, and which applies another voltage to the electrode unit while it passes by the predetermined position, a detecting unit which detects a current or a voltage when the second electricity-supplying unit supplies electricity, and a determining unit which determines the state of the surface of the conveyor belt on the basis of the detected current or voltage.

28 Claims, 7 Drawing Sheets

PRIOR ART

SHEET CONVEYING DEVICE AND IMAGE FORMING APPARATUS INCLUDING THE SAME

BACKGROUND OF THE INVENTION

1. Field of the Invention

The present invention relates to sheet conveying devices and image forming apparatuses including the sheet conveying devices.

2. Description of the Related Art

Inkjet image forming apparatuses using full-line print heads capable of performing high-speed, high-quality printing on sheets are known in the art. In image forming apparatuses of this type, sheet conveying devices are commonly used in which conductive electrodes charge a conveyor belt for conveying a sheet with electricity so that an electrostatic force is generated and the sheet is thereby retained and conveyed by the conveyor belt.

An example of a known sheet conveying device will be described below with reference to FIGS. 3, 4, and 6.

FIG. 3 is a plan view showing the construction of a conveyer belt, and FIG. 4 is a sectional view of the conveyer belt shown in FIG. 3 cut along line IV—IV. FIG. 6 is a side view showing the construction of a known sheet conveying device.

A known sheet conveying device includes a sheet-retaining unit 36 which serves as an electrode unit for retaining a sheet, a conveyor belt 31 which conveys the sheet while retaining it, and an electricity-supplying unit J which applies a voltage to the sheet-retaining unit 36 to generate an attractive force.

The conveyor belt 31 is an endless belt driven by a driving roller 34 and is disposed around a conveying roller 32 and a pressure roller 35 which are driven rollers. A belt motor (not shown) serves as a driving source of the driving roller 34. The conveyor belt 31 includes the sheet-retaining unit 36, a base layer 36*c*, and a surface layer 36*d*. The sheet-retaining unit 36 is formed of electrode plates 36*a* and electrode plates 36*b* formed of a conductive metal, electricity-receiving members 36*e*1 disposed at an end of the electrode plates 36*a*, and electricity-receiving members 36*e*2 disposed at an end of the electrode plates 36*b*.

FIG. 3 is a plan view of the conveyor belt 31. As shown in the figure, the electrode plates 36*a* and the electrode plates 36*b* are alternately arranged in a comb-like pattern.

More specifically, the electrode plates 36*a* and the electrode plates 36*b* extend in a direction crossing a sheet-conveying direction C, that is, the direction in which the conveyor belt 31 conveys a sheet, or in a direction approximately perpendicular to the sheet-conveying direction C. In addition, multiple electrode plates 36*a* and multiple electrode plates 36*b* are alternately formed on the conveyor belt 31 in the sheet-conveying direction C. All of the electrode plates 36*a* and the electrode plates 36*b* are formed in the same length, and are arranged parallel to each other such that the ends thereof are aligned.

The electricity-receiving members 36*e*1 formed of a conductive material are disposed at one end of the electrode plates 36*a* arranged on the conveyor belt 31. In addition, the electricity-receiving members 36*e*2 formed also of a conductive material are disposed at an end of the electrode plates 36*b* opposite to the end at which the electricity-receiving members 36*e*1 are disposed. The thickness of the electricity-receiving members 36*e*1 and 36*e*2, that is, the vertical size thereof in FIG. 4, is set larger than the thickness of the electrode plates 36*a* and 36*b*. In addition, top surfaces of the surface layer 36*d* and the electricity-receiving members 36*e*1 and 36*e*2 are made approximately even so that the top surfaces of the electricity-receiving members 36*e*1 and 36*e*2 face outwards from the top surface of the surface layer 36*d* (that is, so that the top surfaces of the surface layer 36*d* and the electricity-receiving members 36*e*1 and 36*e*2 are in the same plane). The size of the electricity-receiving members 36*e*1 and 36*e*2 in the sheet-conveying direction C is 1 cm, and electricity can be supplied, or eliminated, to/from the electrode plates 36*a* and 36*b* via different paths.

In addition, the electrode plates 36*a* and 36*b* are protected between the base layer 36*c* and the surface layer 36*d* in an area in which an attractive force for retaining the sheet is generated.

The base layer 36*c* and the surface layer 36*d* are formed of a synthetic resin such as polyethylene, polyamide, a fluorocarbon resin including polyvinylidene fluoride (PVDF), polycarbonate, and polyimide. In addition, the volume resistivity of the base layer 36*c* is set in the range of $10^{12}$ to $10^{17}$ Ωcm, and that of the surface layer 36*d* is set in the range of $10^{9}$ to $10^{13}$ Ωcm.

The electricity-receiving members 36*e*1 and 36*e*2 are formed of, for example, a conductive synthetic resin containing carbon, silver, a conductive paste containing copper powder, whose volume resistivity is $10^{-1}$ to $10^{5}$ Ωcm.

In addition, the top surfaces of the surface layer 36*d* and the electricity-receiving members 36*e*1 and 36*e*2 are coated with a fluorocarbon resin, etc., so that water repellency thereof increases.

The known electricity-supplying unit J shown in FIG. 6 includes an electricity-supplying electrode 52' which extends in the sheet-conveying direction C, a pair of electricity-supplying brushes 51' disposed at the bottom of the electricity-supplying electrode 52', and a supporter 53' which retains the electricity-supplying electrode 52' and the pair of electricity-supplying brushes 51'.

The pair of electricity-supplying brushes 51' extend parallel to each other at positions directly above the electricity-receiving members 36*e*1 and the 36*e*2 such that they are in contact with the electricity-receiving members 36*e*1 and 36*e*2, respectively. One of the electricity-supplying brushes 51' applies a positive voltage to the electrode plates 36*a* via the electricity-receiving members 36*e*1, and the other electricity-supplying brush 51' applies a negative voltage to the electrode plates 36*b* via the electricity-receiving members 36*e*2.

When a voltage is applied to the electrode plates 36*a*, an electric force is generated in the direction shown by the arrows in FIG. 4, so that electric flux lines are obtained. Then, an attractive force is generated at the top surface of the conveyor belt 31 due to the voltage difference between the electrode plates 36*a* and the electrode plates 36*b*, and the sheet is retained on the conveyor belt 31 by the attractive force.

However, in the sheet conveying device which is constructed as shown in FIG. 6, even when a sheet cannot be normally conveyed and no sheet is ready in an image-forming operation, or even when the conveyor belt is stained with ink, etc., and the stain is transferred to the paper, such an abnormal state cannot be detected. Accordingly, there is a risk in that the image-forming operation will be performed even though the sheet is absent, so that the surface of the conveyor belt will be stained. In addition, there is also a risk in that the operation of supplying electricity to the sheet-retaining unit cannot be performed effectively because of the stain on the surface of the conveyor belt, so that the sheet cannot be retained with a sufficient attractive force.

In order to detect the situations in which the sheet is absent or the conveyor belt is stained, a sheet detecting unit and a belt stain detecting unit are both required. However, this leads to an increase in costs.

SUMMARY OF THE INVENTION

The present invention can provide a sheet conveying device in which a stain on the surface of a conveyor belt and the presence/absence of a sheet on the conveyor belt can be detected with a simple construction, and can provide an image forming apparatus including the sheet conveying device.

According to the present invention, a sheet conveying device used for conveying a sheet includes an endless conveyor belt which includes an endless conveyor belt which includes an electrode unit for retaining the sheet with an electric force and which rotates while retaining the sheet so as to convey the sheet along a sheet-conveying path; a first electricity-supplying unit which applies a voltage to the electrode unit while the electrode unit passes through a predetermined area due to the rotation of the conveyor belt; a second electricity-supplying unit which is disposed at a predetermined position which is upstream of the predetermined area and downstream of a position where the conveyor belt receives the sheet along the sheet-conveying path, and which applies another voltage to the electrode unit while the electrode unit passes by the predetermined position; a detecting unit which detects a current or a voltage when the second electricity-supplying unit supplies electricity to the electrode unit; and a determining unit which determines the state of the surface of the conveyor belt on the basis of the detected current or voltage.

According to another aspect of the present invention, an image forming apparatus, which forms an image on a sheet by using a print head, includes an endless conveyor belt which includes an electrode unit for retaining the sheet with an electric force and which rotates while retaining the sheet so as to convey the sheet along a sheet-conveying path; a first electricity-supplying unit which applies a voltage to the electrode unit while the electrode unit passes through a predetermined area due to the rotation of the conveyor belt; a print head receiving unit which is disposed close to the first electricity-supplying unit and which receives the print head which forms an image on the sheet in the predetermined area; a second electricity-supplying unit which is disposed at a predetermined position which is upstream of the predetermined area and downstream of a position where the conveyor belt receives the sheet along the sheet-conveying path, and which applies another voltage to the electrode unit while the electrode unit passes by the predetermined position; a detecting unit which detects a current or a voltage when the second electricity-supplying unit supplies electricity to the electrode unit; and a determining unit which determines the state of the surface of the conveyor belt on the basis of the detected current or voltage.

According to yet another aspect of the present invention, a sheet conveying method for conveying a sheet using an endless conveyor belt which includes an electrode unit for retaining the sheet with an electric force and which rotates while retaining the sheet so as to convey the sheet along a sheet-conveying path, includes a first electricity-supplying step for applying a voltage to the electrode unit while the electrode unit passes through a predetermined area due to the rotation of the conveyor belt; a second electricity-supplying step which applies another voltage to the electrode unit while the electrode unit passes by a predetermined position, the predetermined position being upstream of the predetermined area and downstream of a position where the conveyor belt receives the sheet along the sheet-conveying path; a detecting step for detecting a current or a voltage when electricity is supplied to the electrode unit in the second electricity-supplying step; and a determining step which determines the state of the surface of the conveyor belt on the basis of the detected current or voltage.

Further objects, features and advantages of the present invention will become apparent from the following description of the preferred embodiments with reference to the attached drawings.

DESCRIPTION OF THE PREFERRED EMBODIMENT

Figure 1:
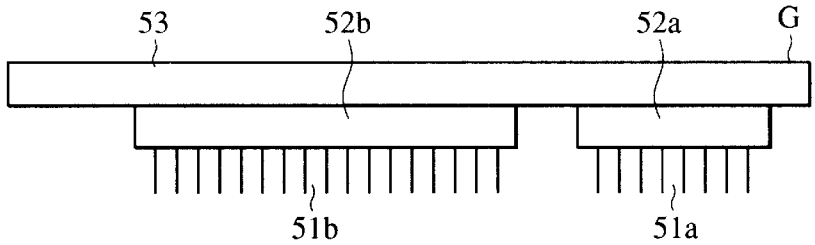
FIG. 1 is a diagram showing an electricity-supplying unit of a sheet conveying device according to an embodiment of the present invention.

An embodiment of the present invention will be described below with reference to the accompanying drawings.

Similarly to the above-described sheet conveying device of the known art, a sheet conveying device according to an embodiment of the present invention includes an electrode unit for retaining a sheet, a conveyor belt which conveys the sheet while retaining it, and an electricity-supplying unit which faces the surface of the conveyor belt on which the sheet is to be retained and which applies a voltage to electricity-receiving members of the conveyor belt. The conveyor belt and a sheet-retaining structure thereof according to the present embodiment are the same as those of the above-described sheet conveying device of the known art. Accordingly, components similar to those described above are denoted by the same reference numerals and explanations thereof are omitted.

FIG. 1 is a diagram showing the electricity-supplying unit according to the present embodiment. The sheet conveying device of the present embodiment is similar to the known sheet conveying device except for the construction of the electricity-supplying unit. With reference to FIG. 1, an electricity-supplying unit G included in the sheet-conveying device of the present embodiment is divided into two parts in the sheet-conveying direction. More specifically, the electricity-supplying unit G includes two electricity-supplying electrodes 52*a* and 52*b* which extend in the sheet-conveying direction and which have different lengths in that direction, electricity-supplying brushes 51*a* and 51*b* which are disposed on the electricity-supplying electrodes 52*a* and 52*b*, respectively, at surfaces facing the conveyor belt 31, and a supporter 53 which retains the electricity-supplying electrodes 52*a* and 52*b*. The electricity-supplying brushes 51*a* and 51*b* are pressed against the electricity-receiving members 36*e*1 of the conveyor belt 31 at a predetermined pressure. Another electricity-supplying unit G' (not shown), which is constructed similarly to the electricity-supplying unit G, is disposed above the electricity-receiving members 36*e*2. This electricity-supplying unit G' and the electricity-supplying unit G disposed above the electricity-receiving members 36*e*1 form a pair and are arranged parallel to each other.

The electricity-supplying brushes 51*a* and 51*b*are preferably formed of a conductive material whose volume resistivity is $10^{-1}$ to $10^{5}$ Ωcm.

In FIG. 1, the electricity-supplying electrode 52*a* placed at the right side in the figure is upstream of the electricity-supplying electrode 52*b* placed at the left side in the figure along a sheet-conveying path, and is downstream of a position where the conveyor belt 31 receives the sheet along the sheet-conveying path. In the figure, the sheet is conveyed from the right to the left below the electricity-supplying electrodes 52*a* and 52*b*.

The electricity-supplying brush 51*b* of the electricity-supplying unit G is in contact with the electricity-receiving members 36*e*1 of the sheet-retaining unit 36, and electricity is supplied to the electricity-receiving members 36*e*1 from the electricity-supplying brush 51*b*.

The length of the electricity-supplying electrode 52*a* in the sheet-conveying direction C is 5 cm, and the length of the electricity-supplying electrode 52*b* in the sheet-conveying direction C is 20 cm.

The electricity-supplying electrode 52*b* and the electricity-supplying brush 51*b* form a first electricity-supplying member, and the electricity-supplying electrode 52*a* and the electricity-supplying brush 51*a* form a second electricity-supplying member. The first and second electricity-supplying members are arranged with a 3 cm gap therebetween. This gap size is determined such that any one of the electricity-receiving members 36*e*1 and 36*e*2 arranged on the conveyor belt does not come into contact with the electricity-supplying brush 51*a* and the electricity-supplying brush 51*b* at the same time, by taking into account the size of the electricity-receiving members 36*e*1 and 36*e*2 in the sheet-conveying direction C, which is 1 cm.

An operation of forming an image on the sheet is performed by a print head unit, which will be described below, at a region where the electricity-supplying electrode 52*b*, which is downstream of the electricity-supplying electrode 52*a* in the sheet-conveying direction, supplies electricity. In this region, the sheet must be strongly retained by the sheet-retaining unit 36.

Figure 2:
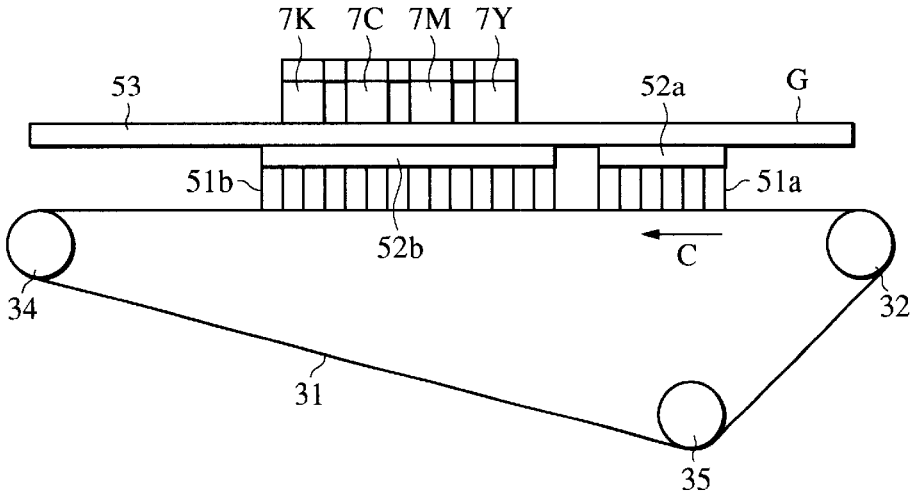
FIG. 2 is a diagram showing the positional relationship between an electrode unit for retaining a sheet, a conveyor belt, and a print head according to the embodiment.

FIG. 2 is a diagram showing the positional relationship between the conveyor belt and the print head unit. This print head unit is used in an image forming apparatus including the sheet conveying device, which will be described below. The print head unit includes print heads 7Y, 7M, 7C, and 7K, corresponding to yellow, magenta, cyan, and black, respectively, in that order from upstream to downstream in the sheet-conveying direction, and is disposed such that the print head unit faces the sheet conveyed by the conveyor belt 31. The size of each print head in the sheet-conveying direction is 2 cm, and each head is arranged with a 3 cm pitch. When the front end of the sheet reaches the position under the print head 7Y, a voltage of 3.0 kV is supplied to the electricity-receiving members 36*e*1 from the electricity-supplying electrode 52*b*, so that the sheet is retained by the sheet-retaining unit 36 of the conveyor belt 31. The size of the electricity-supplying electrode 52*b* in the sheet-conveying direction C is set to 20 cm so that electricity can be reliably supplied to a region which extends from a position upstream of the most upstream print head 7Y to a position downstream of the most downstream print head 7K.

Figure 3:
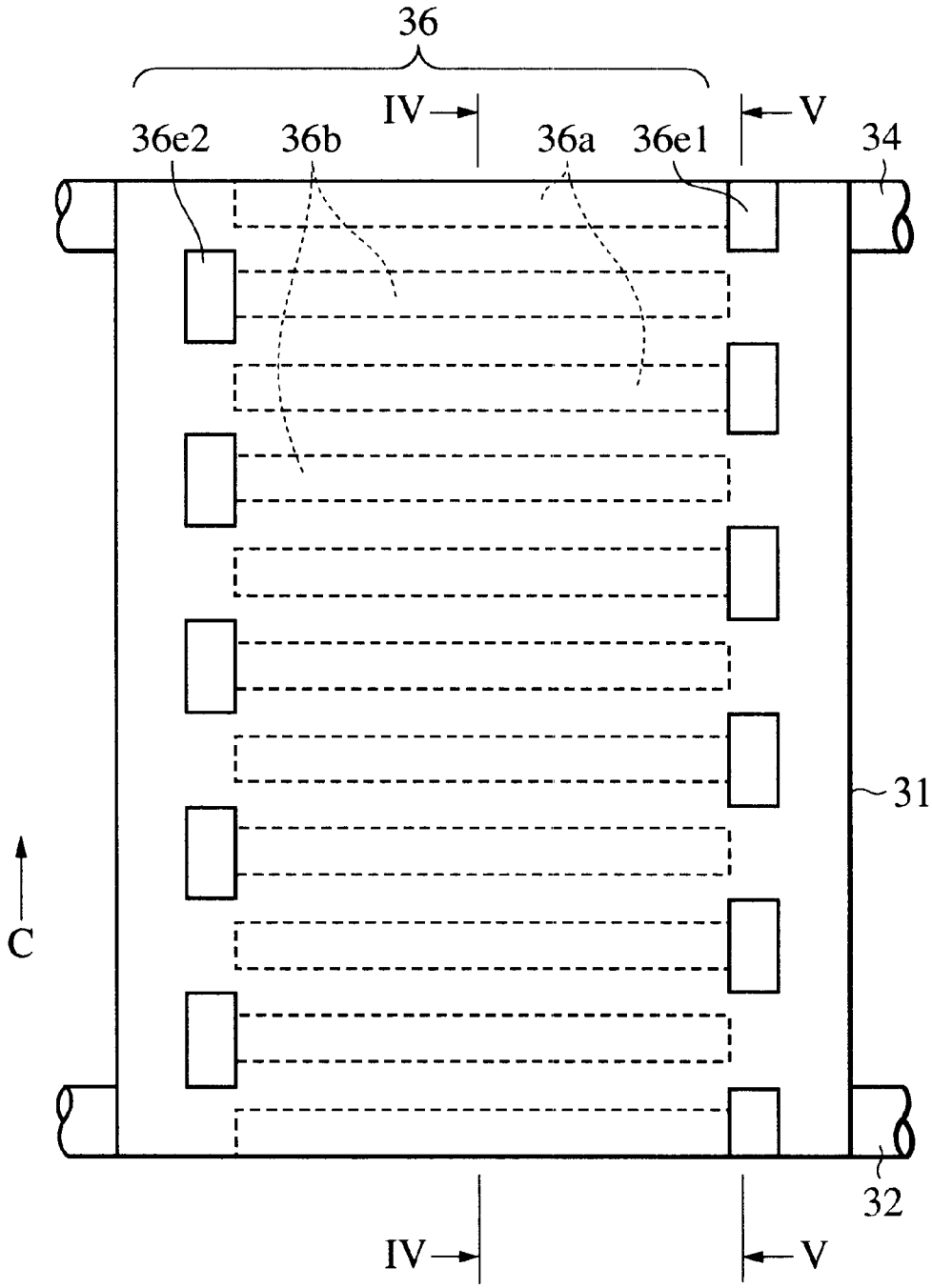
FIG. 3 is a diagram showing the conveyor belt according to the embodiment seen from above.
Figure 4:
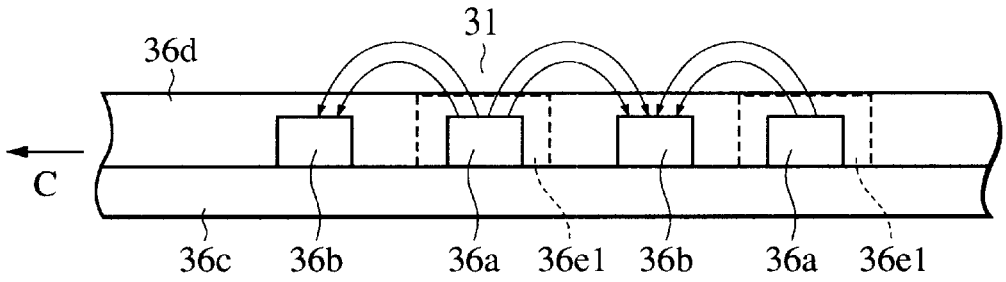
FIG. 4 is a sectional view of FIG. 3 cut along line IV—IV, showing the inner structure of the conveyor belt according to the embodiment.
Figure 5:
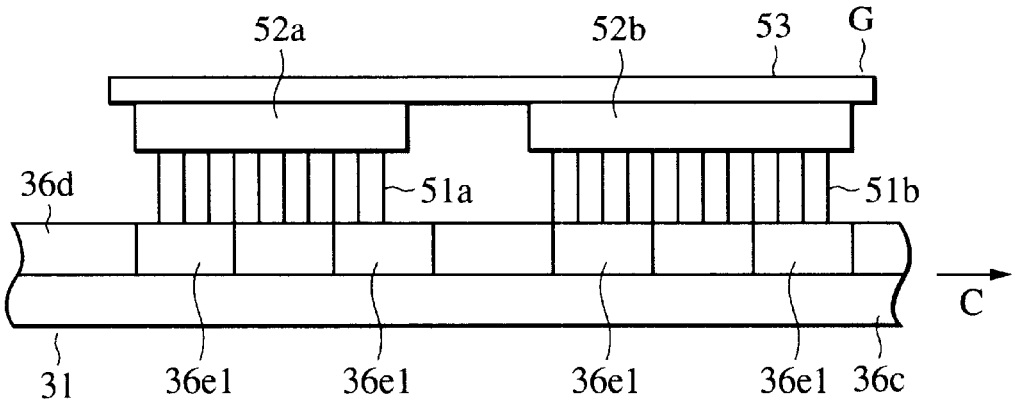
FIG. 5 is a sectional view of FIG. 3 cut along line V—V, showing the sheet-retaining unit according to the embodiment.
Figure 6:
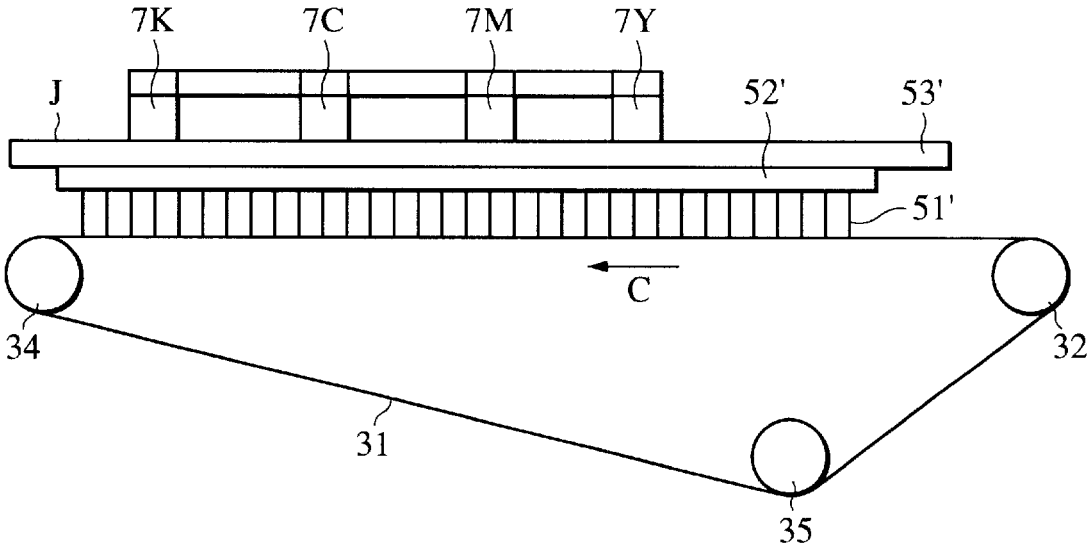
FIG. 6 is a diagram showing the positional relationship between a sheet-retaining structure and a conveyor belt in a sheet conveying device of the known art.

FIG. 5 is a sectional view of FIG. 3 cut along line V—V, showing a manner in which electricity is supplied to the sheet-retaining unit 36 of the conveyor belt 31 from the electricity-supplying electrode 52*b* and the electricity-supplying brush 51*b* forming the first electricity-supplying member. The electricity-supplying brush 51*b* of the electricity-supplying unit G is pressed against the electricity-receiving members 36*e*1 at a constant pressure, and a high-voltage power source (not shown) applies a positive voltage to the electricity-receiving members 36*e*1 so as to supply electricity thereto. In addition, the electricity-supplying brush 51*b* of the electricity-supplying unit G' is pressed against the electricity-receiving members 36*e*2 at a constant pressure, and the high-voltage power source (not shown) applies a negative voltage to the electricity-receiving members 36*e*2 so as to supply electricity thereto by using the electricity-supplying brush 51*b* as a terminal.

In the conveyor belt of the sheet conveying device according to the present embodiment, the volume resistivity of the base layer is set larger than that of the surface layer. Therefore, the amount of electric flux lines obtained at the sheet-retaining unit 36 when electricity is supplied from the electricity-supplying brush 51*b* increases toward the top surface of the conveyor belt 31 on which the sheet is retained. Accordingly, a large sheet-retaining force is obtained.

Figure 7:
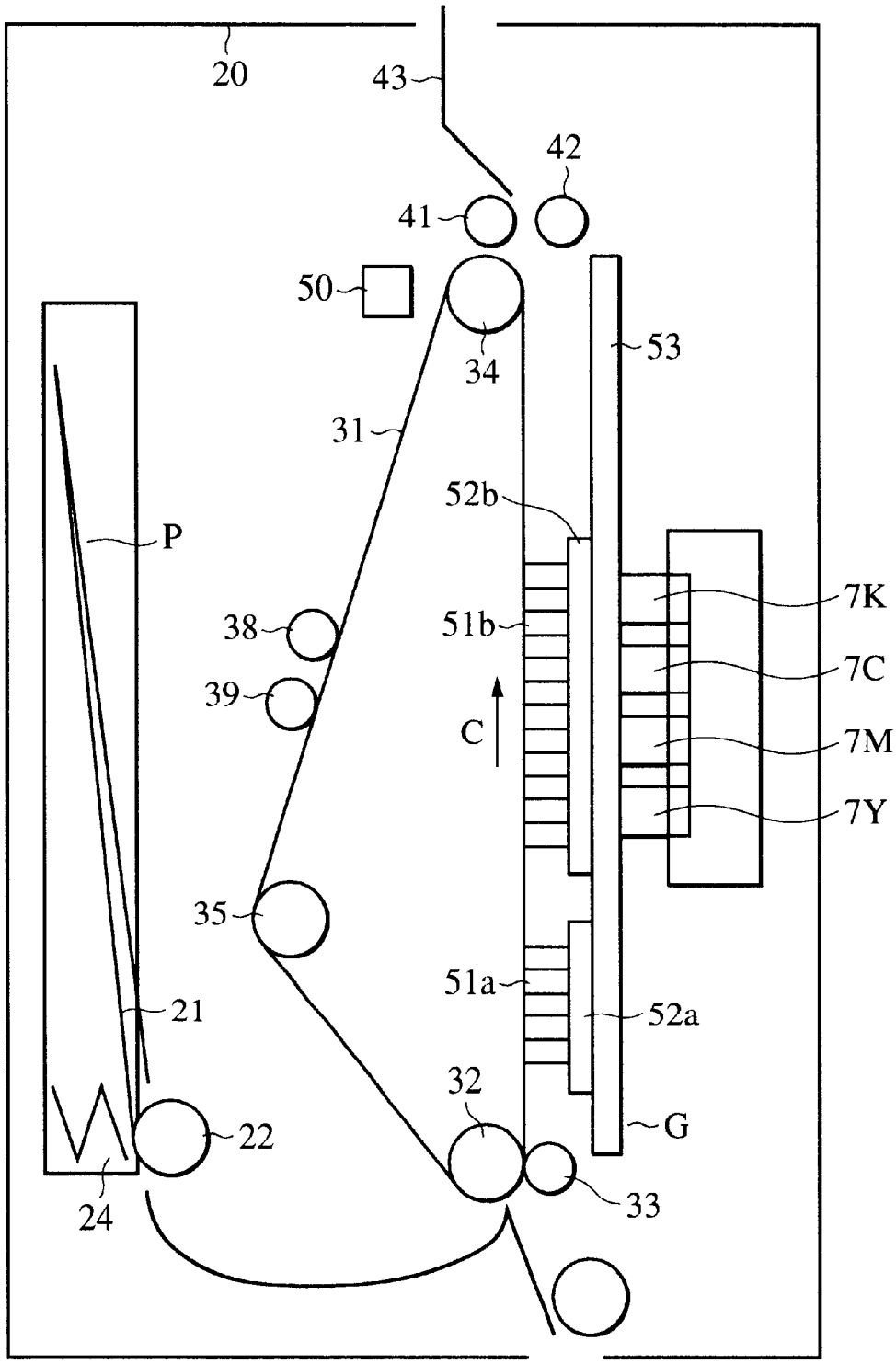
FIG. 7 is a diagram showing the overall construction of an image forming apparatus containing the sheet conveying device according to the embodiment.

FIG. 7 is a sectional view showing the overall construction of an image forming apparatus containing the sheet conveying device according to the present embodiment.

A sheet feeding unit includes a pressure plate 21 on which sheets P are stacked, a feeding roller 22 which rotates around a rotating shaft fixed on a base 20 and which picks up the sheets P, and a spring 24 which presses the sheets P stacked on the pressure plate 21 against the feeding roller 22. The pressure plate 21 includes a separation pad (not shown) which has a large coefficient of friction and which serves to prevent double feeding and a separation claw (not shown) which separates the sheets P from each other. In addition, a release cam (not shown) is provided for separating the pressure plate 21 and the feeding roller 22 from each other.

In a standby state, the release cam presses the pressure plate 21 downward so that the sheets P and the feeding roller 22 are separated from each other. When a driving force applied from the conveying roller 32 is transferred to the feeding roller 22 and to the release cam by gears, etc., the release cam comes away from the pressure plate 21, so that the pressure plate 21 moves upward. Accordingly, the feeding roller 22 comes into contact with the sheet P at the top of the stack, and the sheet P is picked up and transferred due to the rotation of the feeding roller 22. The feeding roller 22 continuously rotates until the sheet P is received by a sheet-conveying unit.

The sheet-conveying unit includes the conveyor belt 31 which conveys the sheet P while retaining it and a PE sensor (not shown).

The electricity-supplying unit G supplies a positive voltage of 0.5 to 10 kV to the electricity-receiving members 36*e*1 of the sheet-retaining unit 36, and the electricity-supplying unit G' (not shown) supplies a negative voltage of −0.5 to −10 kV to the electricity-receiving members 36*e*2 of the sheet-retaining unit 36. Accordingly, the sheet P is retained by the conveyor belt 31. The conveyor belt 31 is set to move at 170 mm/sec.

A pinch roller 33 which is rotated by the conveyor belt 31 is disposed at a position such that the pinch roller 33 opposes the conveying roller 32 with the conveyor belt 31 therebetween, that is, at a position close to a position where the conveyor belt 31 receives the sheet P. The print head unit including the print heads 7K, 7C, 7M, and 7Y is disposed in a print head receiving unit which is downstream of the conveying roller 32 in the sheet-conveying direction.

The print head unit is a line-type inkjet print head unit in which a plurality of nozzles are arranged in the direction perpendicular to the sheet-conveying direction C, and the resolution thereof is 600 dots per inch (DPI). The print head unit may also be mounted on a carriage which serves as the print head receiving unit and which moves in the direction perpendicular to the sheet-conveying direction for serial scanning.

The print heads 7Y, 7M, 7C, and 7K are constructed such that ink contained therein can be heated by using a heater, etc. Film boiling occurs in the ink due to the heat applied, so that bubbles are generated and ink drops are discharged from nozzles in accordance with the pressure change caused by the growth and shrinkage of the generated bubbles. Accordingly, an image is formed on the sheet P.

A sheet output unit includes an output roller 41 and a spur 42 (a roller with a plurality of projections at the periphery), and the sheet P on which the image is formed is transferred by the output roller 41 and the spur 42 to an output tray 43.

Reference numeral 38 denotes a cleaning roller used for cleaning the conveyor belt 31, and reference numeral 39 denotes an electricity-eliminating brush which removes the electric charge remaining on the sheet-retaining unit 36 of the conveyor belt 31 by grounding it.

Figure 8:
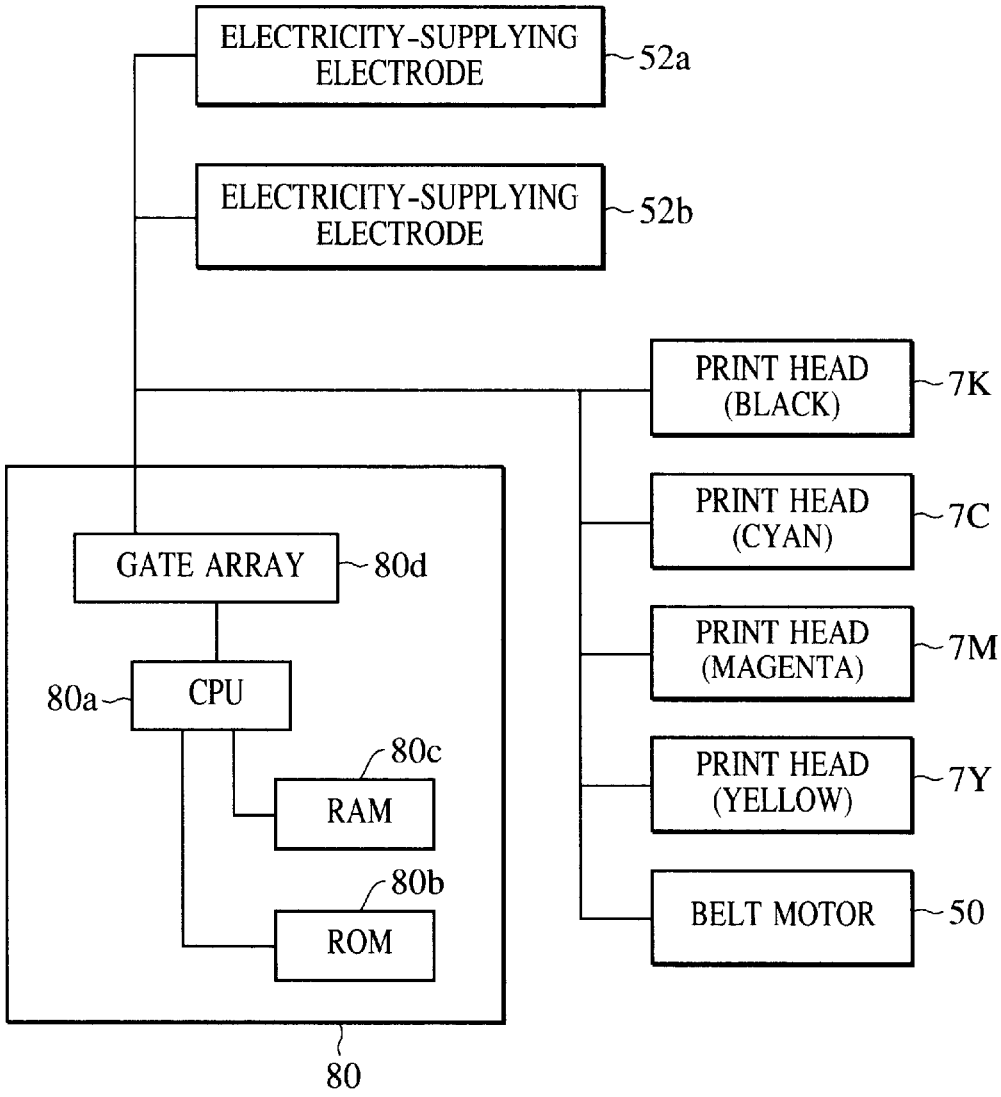
FIG. 8 is a diagram showing a control block used in the image forming apparatus containing the sheet conveying device according to the embodiment.

FIG. 8 shows a control block of the image forming apparatus.

FIG. 8, reference numeral 80 denotes a control unit having a determining function, and includes a central processing unit (CPU) 80*a* which operates in accordance with a control program, a read only memory (ROM) 80*b* which stores the control program, and a random access memory (RAM) 80*c* which stores data used for detecting the absence of a sheet, the stain on the conveyor belt, etc. This data includes voltages, etc., corresponding to the conditions including the kind of sheet, temperature, and humidity, and data to be used for detecting the stain on a sheet or the presence/absence of a sheet is selected manually, or by using a sensor or the like. A gate array 80*d* is a large scale integrated (LSI) circuit which, together with the CPU 80*a*, controls signals transmitted to the print head and to the electricity-supplying electrodes.

The control unit 80 is connected to a belt motor 50 which serves as a driving source for rotating the conveyor belt 31, the above-described electricity-supplying electrodes 52*a* and 52*b*, and the print heads 7Y, 7M, 7C, and 7K.

Figure 9:
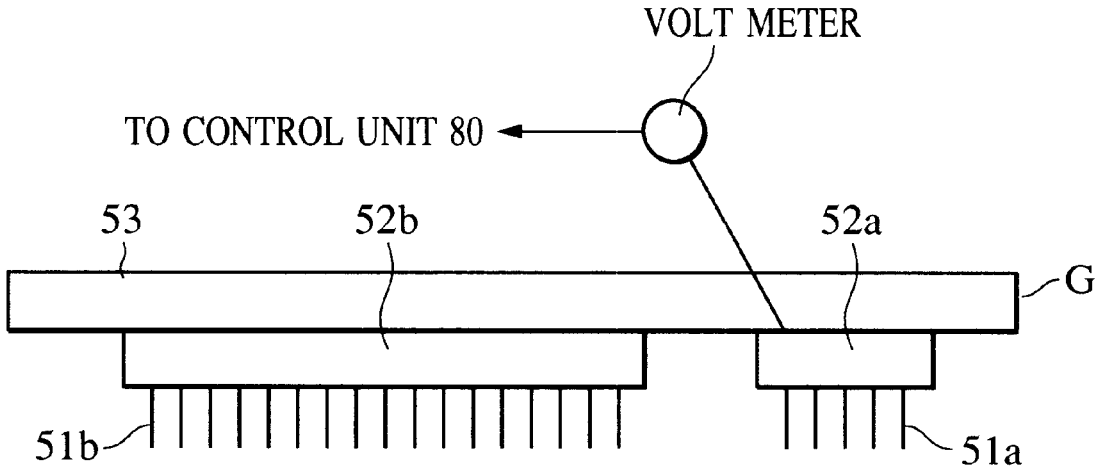
FIG. 9 is a diagram showing a manner in which a voltage is detected while electricity is supplied in the sheet conveying device according to the embodiment.

FIG. 9 is a diagram showing a manner in which the voltage is detected while electricity is supplied to the electricity-receiving members 36*e*1 via the electricity-supplying electrode 52*a* and the electricity-supplying brushes 51*a*, which serve as the second electricity-supplying member of the electricity-supplying unit G.

The electricity-supplying electrode 52*a* receives electricity via a resistor having a predetermined resistance R (Ω), so that a current which flows while electricity is supplied from the second electricity-supplying member to the above-described electrode unit is converted into a voltage. A voltmeter is connected across the resistor so as to detect the voltage across the resistor, and the detected voltage is transmitted to the control unit 80.

The control unit 80 compares the detected voltage with predetermined voltage data stored in the RAM 80*c*, and when the detected voltage is lower than a predetermined voltage, it is determined that the sheet is absent and an operation of discharging ink from the print heads is stopped. In addition, when the detected voltage is higher than another predetermined voltage data, it is determined that the surface of the conveyor belt is stained, and a printing operation using the print heads is stopped and a cleaning operation for cleaning the surface of the conveyor belt 31 is performed. The predetermined voltages stored in the RAM 80*c* include a stain-detection reference voltage, a sheet-detection reference voltage, and a defect detection reference voltage, which are determined on the basis of a voltage V1 obtained when the sheet is retained on the conveyor belt 31, a voltage V0 obtained when nothing is retained on the conveyor belt 31, and a voltage V2 obtained when the surface of the conveyor belt is stained.

As described above, according to the present embodiment, the current which flows while electricity is supplied from the second electricity-supplying member to the electricity-receiving members is converted into a voltage, and this voltage is compared with the reference voltages. However, the present invention is not limited to this, and the current which flows while electricity is supplied from the second electricity-supplying member to the electricity-receiving members may also be directly detected and compared with reference currents. Also in this case, the state of the surface of the conveyor belt can be determined similarly to when the voltage is detected as described above.

When the current is used for determining the state of the surface of the conveyor belt, an ammeter is used for detecting the current, and the RAM 80*c* stores a stain-detection reference current, a sheet-detection reference current, and a defect detection reference current, which are determined on the basis of a current I1 obtained when the sheet is retained on the conveyor belt 31, a current I0 obtained when nothing is retained on the conveyor belt 31, and a current I2 obtained when the surface of the conveyor belt 31 is stained.

The sheet conveyed by the sheet conveying device of the present invention may be, for example, copy paper, printer paper, inkjet paper including glossy paper, OHP sheets, etc.

An experiment was performed in which the image forming apparatus according to the present embodiment was operated and various kinds of images were printed for two hours. During this time, an abnormal sheet-conveying operation was detected once, and the stain on the conveyor belt was detected twice. As a result, the conveyor belt was prevented from being severely stained, and printing failure and misprinting did not occur. In addition, the sheets were also not severely stained on the back.

In addition, the sheet conveying device of the present embodiment may also include a temperature/humidity sensor which serves as a temperature/humidity detecting unit. In such a case, the memory may store voltages corresponding to predetermined currents (a current which flows when the sheet is absent and a current which flows when the conveyor belt is stained) obtained under the condition in which the temperature/humidity is in the range of, for example, 5° C./10% RH to 35° C./90% RH. An experiment was performed in which various kinds of images were printed for three hours while trying to detect the stains on the conveyor belt and the presence/absence of a sheet by using the predetermined voltages corresponding to the above-described temperature/humidity condition as references. During this time, an abnormal sheet-conveying operation (absence of a sheet, etc.) was detected once, and the stain on the conveyor belt was detected three times. As a result, printing failure due to the absence of a sheet, reduction in sheet-retaining force due to a severe stain on the conveyor belt, and transferring of the stain from the conveyor belt to the sheet were prevented. In addition, misprinting did not occur and the sheets were not stained.

As described above, the present embodiment provides a sheet conveying device including the first electricity-supplying member which supplies electricity to the sheet-retaining unit passing through a predetermined area and the second electricity-supplying member which supplies electricity to the sheet-retaining unit at a predetermined position which is upstream of the predetermined area and downstream of a position where the conveyor belt receives the sheet along a sheet-conveying path, and also provides an image-forming apparatus using the sheet conveying device. While the second electricity-supplying member supplies electricity, the stain on the surface of the conveyor belt and the presence/absence of a sheet on the conveyor belt are detected at the predetermined position by converting a current which flows during this electricity-supplying operation into a voltage, detecting the voltage by using a voltage-detecting unit, and comparing the detected voltage with predetermined voltages.

Alternatively, according to the sheet-conveying device and the image-forming apparatus of the present embodiment, while the second electricity-supplying member supplies electricity, the stain on the surface of the conveyor belt and the presence/absence of a sheet on the conveyor belt may also be detected at the predetermined position by detecting a current which flows during this electricity-supplying operation by using a current-detecting unit and comparing the detected current with predetermined currents.

Since the sheet conveying device and the image forming apparatus according to the present embodiment are constructed with a smaller number of components compared to those of the known art, the presence/absence of a sheet and the stain on the surface of the conveyor belt can be detected at a lower cost.

In addition, even when leakage occurs due to a scar, a pin hole, etc., formed in the conveyor belt, such an abnormal state can be immediately detected, and the operation can be stopped on the basis of the detection result, so that the reliability of the sheet-conveying operation can be increased.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet conveying device used for conveying a sheet, comprising:

an endless conveyor belt which includes a first group of electrodes and a second group of electrodes for retaining the sheet with an electric force and which rotates while retaining the sheet so as to convey the sheet along a sheet-conveying path;

a first electricity-supplying unit which applies voltages to the first group of electrodes and the second group of electrodes to generate a voltage difference between the first group of electrodes and the second group of electrodes, while the first group of electrodes and the second group of electrodes pass through a predetermined area due to the rotation of the conveyor belt;

a second electricity-supplying unit which is disposed at a predetermined position which is upstream of the predetermined area and downstream of a position where the conveyor belt receives the sheet along the sheet-conveying path, and which applies voltages to the first group of electrodes and the second group of electrodes to generate a voltage difference between the first group of electrodes and the second group of electrodes, while the first group of electrodes and the second group of electrodes pass by the predetermined position;

a detecting unit which detects a current or a voltage of the second electricity-supplying unit when the second electricity-supplying unit supplies electricity to the first group of electrodes and the second group of electrodes; and a determining unit which determines the state of the surface of the conveyor belt on the basis of the detected current or voltage.

2. A sheet conveying device according to claim 1, wherein the determining unit determines that the surface of the conveyor belt passing by the predetermined position is stained when the detected current or voltage is higher than a predetermined stain detection reference value.

3. A sheet conveying device according to claim 1, wherein the determining unit determines that no sheet is retained on the surface of the conveyor belt passing by the predetermined position when the detected current or voltage is lower than a predetermined sheet detection reference value.

4. A sheet conveying device according to claim 1, wherein the determining unit determines that the surface of the conveyor belt passing by the predetermined position has a defect when the detected current or voltage is higher or lower than a predetermined defect detection reference value by a predetermined amount or more.

5. A sheet conveying device according to claim 1, further comprising a temperature/humidity detection unit which detects internal temperature and humidity, wherein the determining unit determines that the surface of the conveyor belt passing by the predetermined position is stained when the detected current or voltage is higher than a predetermined stain detection reference value corresponding to the detected temperature and humidity.

6. A sheet conveying device according to claim 1, further comprising a temperature/humidity detection unit which detects internal temperature and humidity, wherein the determining unit determines that no sheet is retained on the surface of the conveyor belt passing by the predetermined position when the detected current or voltage is lower than a predetermined sheet detection reference value corresponding to the detected temperature and humidity.

7. A sheet conveying device according to claim 1, further comprising a temperature/humidity detection unit which detects internal temperature and humidity, wherein the determining unit determines that the surface of the conveyor belt passing by the predetermined position has a defect when the detected current or voltage is higher or lower than a predetermined defect detection reference value corresponding to the detected temperature and humidity by a predetermined amount or more.

8. A sheet conveying device according to claim 1, wherein the first group of electrodes includes electrodes which extend approximately perpendicularly to the sheet-conveying path on the conveyor belt and which receive a positive voltage from the first and the second electricity-supplying units and the second group of electrodes includes electrodes which extend approximately perpendicularly to the sheet-conveying path on the conveyor belt and which receive a negative voltage from the first and the second electricity-supplying units, the the electrodes of the first group and the electrodes of the second group being alternately arranged at predetermined intervals along a sheet-conveying direction.

9. An image forming apparatus which forms an image on a sheet by using a print head, said image forming apparatus comprising:

an endless conveyor belt which includes a first group of electrodes and a second group of electrodes for retaining the sheet with an electric force and which rotates while retaining the sheet so as to convey the sheet along a sheet-conveying path;

a first electricity-supplying unit which applies voltages to the first group of electrodes and the second group of electrodes to generate a voltage difference between the first group of electrodes and the second group of electrodes, while the first group of electrodes and the second group of electrodes pass through a predetermined area due to the rotation of the conveyor belt;

a print head receiving unit which is disposed close to the first electricity-supplying unit and which receives the print head which forms an image on the sheet in the predetermined area;

a second electricity-supplying unit which is disposed at a predetermined position which is upstream of the predetermined area and downstream of a position where the conveyor belt receives the sheet along the sheet-conveying path, and which applies voltages to the first group of electrodes and the second group of electrodes to generate a voltage difference between the first group of electrodes and the second group of electrodes, while the first group of electrodes and the second group of electrodes pass by the predetermined position;

a detecting unit which detects a current or a voltage of the second electricity-supplying unit when the second electricity-supplying unit supplies electricity to the first group of electrodes and the second group of electrodes; and a determining unit which determines the state of the surface of the conveyor belt on the basis of the detected current or voltage.

10. An image forming apparatus according to claim 9, wherein the determining unit determines that the surface of the conveyor belt passing by the predetermined position is stained when the detected current or voltage is higher than a predetermined stain detection reference value.

11. An image forming apparatus according to claim 9, wherein the determining unit determines that no sheet is retained on the surface of the conveyor belt passing by the predetermined position when the detected current or voltage is lower than a predetermined sheet detection reference value.

12. An image forming apparatus according to claim 9, wherein the determining unit determines that the surface of the conveyor belt passing by the predetermined position has a defect when the detected current or voltage is higher or lower than a predetermined defect detection reference value by a predetermined amount or more.

13. An image forming apparatus according to claim 9, further comprising a temperature/humidity detection unit which detects internal temperature and humidity, wherein the determining unit determines that the surface of the conveyor belt passing by the predetermined position is stained when the detected current or voltage is higher than a predetermined stain detection reference value corresponding to the detected temperature and humidity.

14. An image forming apparatus according to claim 9, further comprising a temperature/humidity detection unit which detects internal temperature and humidity, wherein the determining unit determines that no sheet is retained on the surface of the conveyor belt passing by the predetermined position when the detected current or voltage is lower than a predetermined sheet detection reference value corresponding to the detected temperature and humidity.

15. An image forming apparatus according to claim 9, further comprising a temperature/humidity detection unit which detects internal temperature and humidity, wherein the determining unit determines that the surface of the conveyor belt passing by the predetermined position has a defect when the detected current or voltage is higher or lower than a predetermined defect detection reference value corresponding to the detected temperature and humidity by a predetermined amount or more.

16. An image forming apparatus according to claim 9, wherein the first group of electrodes includes electrodes which extend approximately perpendicularly to the sheet-conveying path on the conveyor belt and which receive a positive voltage from the first and the second electricity-supplying units and the second group of electrodes includes electrodes which extend approximately perpendicularly to the sheet-conveying path on the conveyor belt and which receive a negative voltage from the first and the second electricity-supplying units, the electrodes of the first group and the electrodes of the second group being alternately arranged at predetermined intervals along a sheet-conveying direction.

17. A sheet conveying method for conveying a sheet using an endless conveyor belt which includes a first group of electrodes and a second group of electrodes for retaining the sheet with an electric force and which rotates while retaining the sheet so as to convey the sheet along a sheet-conveying path, said method comprising:

a first electricity-supplying step for applying voltages to the first group of electrodes and the second group of electrodes to generate a voltage difference between the first group of electrodes and the second group of electrodes, while the first group of electrodes and the second group of electrodes pass through a predetermined area due to the rotation of the conveyor belt;

a second electricity-supplying step which applies voltages to the first group of electrodes and the second group of electrodes to generate a voltage difference between the first group of electrodes and the second group of electrodes, while the first group of electrodes and the second group of electrodes pass by a predetermined position, the predetermined position being upstream of the predetermined area and downstream of a position where the conveyor belt receives the sheet along the sheet-conveying path;

a detecting step for detecting a current or a voltage of the second electricity-supplying step when electricity is supplied to the first group of electrodes and the second group of electrodes in the second electricity-supplying step; and a determining step which determines the state of the surface of the conveyor belt on the basis of the detected current or voltage.

18. A sheet conveying method according to claim 17, wherein the determining step determines that the surface of the conveyor belt passing by the predetermined position is stained when the detected current or voltage is higher than a predetermined stain detection reference value.

19. A sheet conveying method according to claim 17, wherein the determining step determines that no sheet is retained on the surface of the conveyor belt passing by the predetermined position when the detected current or voltage is lower than a predetermined sheet detection reference value.

20. A sheet conveying method according to claim 17, wherein the determining step determines that the surface of the conveyor belt passing by the predetermined position has a defect when the detected current or voltage is higher or lower than a predetermined defect detection reference value by a predetermined amount or more.

21. A sheet conveying device for conveying a sheet, comprising:

an endless conveyor belt which includes a first group of electrodes and a second group of electrodes for retaining the sheet with an electric force and which rotates while retaining the sheet so as to convey the sheet along a sheet-conveying path;

an electricity-supplying unit which applies voltages to the first group of electrodes and the second group of electrodes to generate a voltage difference between the first group of electrodes and the second group of electrodes, while the first group of electrodes and the second group of electrodes pass by a predetermined position;

a detecting unit which detects a current to the first group of electrodes from the electricity-supplying unit when the electricity-supplying unit supplies electricity to the first group of electrodes and the second group of electrodes; and a determining unit which determines the state of the surface of the conveyor belt based on the detected current.

22. A sheet conveying device according to claim 21, wherein the determining unit determines that the surface of the conveyor belt passing by the predetermined position is stained when the detected current is higher than a predetermined stain detection reference value.

23. A sheet conveying device according to claim 21, wherein the determining unit determines that no sheet is retained on the surface of the conveyor belt passing by the predetermined position when the detected current is lower than a predetermined sheet detection reference value.

24. A sheet conveying device for conveying a sheet, comprising:

an endless conveyor belt which includes a first group of electrodes and a second group of electrodes for retaining the sheet with an electric force and which rotates while retaining the sheet so as to convey the sheet along a sheet-conveying path;

an electricity-supplying unit which applies voltages to the first group of electrodes and the second group of electrodes to generate a voltage difference between the first group of electrodes and the second group of electrodes, while the first group of electrodes and the second group of electrodes pass by a predetermined position;

a resistor for converting a current to the first group of electrodes from the electricity-supplying unit into a voltage;

a detecting unit which detects the voltage converted by the resistor when the electricity-supplying unit supplies electricity to the first group of electrodes and the second group of electrodes; and a determining unit which determines the state of the surface of the conveyor belt based on the detected voltage.

25. A sheet conveying device according to claim 24, wherein the determining unit determines that the surface of the conveyor belt passing by the predetermined position is stained when the detected voltage is higher than a predetermined stain detection reference value.

26. A sheet conveying device according to claim 24, wherein the determining unit determines that no sheet is retained on the surface of the conveyor belt passing by the predetermined position when the detected voltage is lower than a predetermined sheet detection reference value.

27. An image forming apparatus which forms an image on a sheet by using a print head, said image forming apparatus comprising:

an endless conveyor belt which includes a first group of electrodes and a second group of electrodes for retaining the sheet with an electric force and which rotates while retaining the sheet so as to convey the sheet along a sheet-conveying path;

an electricity-supplying unit which applies voltages to the first group of electrodes and the second group of electrodes to generate a voltage difference between the first group of electrodes and the second group of electrodes, while the first group of electrodes and the second group of electrodes pass by a predetermined position;

a detecting unit which detects a current to the first group of electrodes from the electricity-supplying unit when the electricity-supplying unit supplies electricity to the first group of electrodes and the second group of electrodes;

a determining unit which determines the state of the surface of the conveyor belt based on the detected current; and a print head receiving unit which is disposed close to the electricity-supplying unit and which receives the print head which forms an image on the sheet conveyed by the conveyor belt.

28. An image forming apparatus which forms an image on a sheet by using a print head, said image forming apparatus comprising:

an endless conveyor belt which includes a first group of electrodes and a second group of electrodes for retaining the sheet with an electric force and which rotates while retaining the sheet so as to convey the sheet along a sheet-conveying path;

an electricity-supplying unit which applies voltages to the first group of electrodes and the second group of electrodes to generate a voltage difference between the first group of electrodes and the second group of electrodes, while the first group of electrodes and the second group of electrodes pass by a predetermined position;

a resistor for converting a current to the first group of electrodes from the electricity-supplying unit into a voltage;

a detecting unit which detects the voltage converted by the resistor when the electricity-supplying unit supplies electricity to the first group of electrodes and the second group of electrodes;

a determining unit which determines the state of the surface of the conveyor belt based on the detected voltage; and a print head receiving unit which is disposed close to the electricity-supplying unit and which receives the print head which forms an image on the sheet conveyed by the conveyor belt.

* * * * *